US008789398B2

(12) United States Patent
Stobbe et al.

(10) Patent No.: US 8,789,398 B2
(45) Date of Patent: Jul. 29, 2014

(54) SECURITY LOCK

(75) Inventors: Anatoli Stobbe, Barsinghausen (DE); Wilfried Herrmann, Hannover (DE)

(73) Assignee: EYES OPEN Corporation, Carson City, NV (US)

( * ) Notice: Subject to any disclaimer, the term of this patent is extended or adjusted under 35 U.S.C. 154(b) by 212 days.

(21) Appl. No.: 13/368,603

(22) Filed: Feb. 8, 2012

(65) Prior Publication Data

US 2012/0204610 A1 Aug. 16, 2012

(30) Foreign Application Priority Data

Feb. 11, 2011 (DE) ..... 20 2011 002 661 U

(51) Int. Cl.
*E05B 47/00* (2006.01)

(52) U.S. Cl.
USPC ..... 70/279.1; 70/278.7; 70/486; 70/129

(58) Field of Classification Search
USPC ..... 70/278.1–278.3, 278.7, 279.1, 280, 70/150, 486, 124, 129, 134
See application file for complete search history.

(56) References Cited

U.S. PATENT DOCUMENTS

| | | | | |
|---|---|---|---|---|
| 4,135,377 | A | 1/1979 | Kleefeldt et al. | |
| 4,633,687 | A * | 1/1987 | Fane | 70/276 |
| 4,664,430 | A * | 5/1987 | Bernard | 292/201 |
| 4,685,709 | A * | 8/1987 | Kambic | 292/201 |
| 4,833,465 | A * | 5/1989 | Abend et al. | 340/5.65 |
| 6,147,622 | A * | 11/2000 | Fonea | 340/5.2 |
| 6,434,987 | B1 * | 8/2002 | Juillerat et al. | 70/333 R |
| 6,539,755 | B1 * | 4/2003 | Bruwer et al. | 70/107 |
| 6,964,183 | B2 * | 11/2005 | Keightley | 70/279.1 |
| 8,291,733 | B2 * | 10/2012 | Chiou et al. | 70/224 |
| 8,490,445 | B2 * | 7/2013 | Chiou et al. | 70/279.1 |
| 2004/0031299 | A1 * | 2/2004 | Dimig et al. | 70/186 |
| 2005/0050928 | A1 * | 3/2005 | Frolov et al. | 70/278.3 |
| 2008/0271503 | A1 | 11/2008 | Buschmann | |
| 2012/0204610 | A1 * | 8/2012 | Stobbe et al. | 70/278.7 |

FOREIGN PATENT DOCUMENTS

| | | |
|---|---|---|
| DE | 202010013873 | 1/2011 |
| DE | 202010013880 | 2/2011 |
| EP | 0280755 | 8/1990 |

* cited by examiner

*Primary Examiner* — Suzanne Barrett
(74) *Attorney, Agent, or Firm* — Jeffrey L. Thompson; Thompson & Thompson, P.A.

(57) ABSTRACT

A security lock has a lock bolt that can be moved from an open position into a closed position and vice versa. A manually operated drive is provided to operate the lock bolt. Movement of the lock bolt is blocked in a blocked position by a bolt block. A gearing mechanism is arranged between the bolt block and an electric drive for moving the bolt block from a release position into a block position, and for blocking the bolt block against pivoting in the block position. The gearing mechanism ensures that, starting from a release position, the bolt block is first moved into a block position, and then the bolt block is blocked against pivoting in the opposite direction by continued running of the electric drive. The electric drive can be reversed to remove the block against the bolt block and to move the bolt block into the release position.

11 Claims, 6 Drawing Sheets

SECURITY LOCK

BACKGROUND OF THE INVENTION

1. Field of the Invention

The present invention relates generally to security locks. In particular, the present invention relates to heavy-duty public authority locks, which have a lock bolt that can be manually operated to move from an open position into a closed position and vice versa.

2. Description of the Related Art

A conventional security lock has a blocking mechanism, a lock bolt that interacts with the blocking mechanism, a manually operated drive for operating the lock bolt, and a bolt block. The bolt block has a block position that blocks movement of the lock bolt. The bolt block is a pivotable lever that can be operated by an electric drive. The bolt block has a blocking nose formed on a lock bolt side that engages in a correspondingly formed recess in the lock bolt when the bolt block is in its block position.

The movement of the lock bolt can be blocked in a blocked position by a bolt block. However, it has been found that the bolt block can be released by targeted shaking, which then allows the lock bolt to be opened using the manually operated drive.

There is a need for an improved security lock to overcome this problem.

SUMMARY OF THE INVENTION

An object of the present invention is to provide an improved security lock that does not allow its bolt block to be overcome by manipulation. This object and other objects and advantages are achieved by a security lock having the features set forth in the claims.

According to the solution of the invention, a gearing mechanism is arranged between the bolt block and the electric drive. The gearing mechanism can be used to move the bolt block from a release position into a block position. The bolt block can also be blocked against pivoting in the block position. The gearing mechanism ensures that, starting from a release position, the bolt block is first moved into a block position. A block against pivoting in the opposite direction is then also brought about by continued running of the electric drive.

When the electric drive changes the direction of rotation, a block against pivoting of the bolt block is first removed, and then the bolt block is moved from the block position into the release position.

The gearing mechanism is preferably a driving and blocking member, which is mounted pivotably on the pivotable lever of the bolt block at a distance from the stationary pivot axis thereof. The driving and blocking member has a recess that engages with a stationary peg. The electric drive is coupled with the driving and blocking member at an articulation point. The articulation point lies opposite the recess in relation to the pivot axis of the driving and blocking member, which is arranged on the pivotable lever of the bolt block and is thus movable, or is arranged at an obtuse angle to the position of the recess. The driving and blocking member can be pivoted into a blocking position in the block position of the bolt block. In the blocking position, a blocking face of the driving and blocking member can be moved into a position opposite a stationary stop face.

The articulation point of the electric drive on the driving and blocking member in conjunction with the pivot axis thereof on the pivotable lever of the bolt block and in conjunction with the recess produces a transmission of the force to be expended by the electric drive onto the force exerted on the lever of the bolt block. Moreover, the driving and blocking member can, as soon as the bolt block is in the block position, be further pivoted until it reaches a blocking position. In the blocking position, a blocking face of the driving and blocking member lies opposite a stationary stop face.

Owing to the smaller radius between the pivot axis of the driving and blocking member and the blocking face compared to the radius between the pivot axis of the pivotable lever of the bolt block and the blocking face, the driving and blocking member remains freely movable with respect to the stop face, while the pivotable lever of the bolt block is prevented from pivoting back.

The stationary peg can be arranged axially on the stationary pivot axis of the pivotable lever of the bolt block. A maximum torque on the pivotable lever of the bolt block is produced thereby.

The driving and blocking member preferably comprises a circular disc that can be pivoted about its center. The recess is on an edge of the disc, and a flattened portion is present opposite the recess. The articulation point of the electric drive lies on a connection line between the center and the blocking face.

The selection of a disc produces a balanced distribution of mass around the pivot axis of the disc. Manipulation attempts to pivot the disc by applying force to the security lock and to move the bolt block out of the blocking position in this manner are therefore unsuccessful.

The bolt block can additionally be releasable and pivotable by means of a blocking slide that engages with the blocking mechanism. The bolt block can thereby be released via the blocking mechanism if the electric drive is not functioning. For manual mechanical operation, the driving and blocking member can bear an operating means, preferably in the form of a pin, with which the blocking slide interacts via a ramp. In order to be able to open the lock bolt in an emergency even if the electric drive is not functional, the same movement sequence for releasing and opening the bolt block as is otherwise performed by the electric drive can be triggered by means of the operating means using the blocking slide.

The electric drive preferably has an electric motor and a rotary-linear converter which couples the electric motor with the gearing mechanism. The rotary movement of the electric motor is thereby converted into a lifting movement with a force transmission and can thus act directly on the bolt block or the driving and blocking member thereof.

The rotary-linear converter can have a rotatable spiral spring, which is coupled to a peg which engages in the rotatable spring and is connected to an operating rod which can be moved in a linear manner. The spring facilitates startup of the electric motor, as it does not apply any countermoment during the startup phase. The countermoment only arises in the final phase and helps to reduce the after-running time of the electric motor. Moreover, the spring compensates differences between the drive path defined by the electric motor and the reaction path of the bolt block or the driving and blocking member thereof.

The bolt block can be moved mechanically by means of the blocking slide and/or electromechanically by means of the electric drive from the block position to the open position.

The invention can be applied not only to heavy official locks but also to simple locks in the commercial and private sectors.

BRIEF DESCRIPTION OF THE DRAWINGS

Further advantages and features of the invention can be found in the description below using the figures. In the figures.

DETAILED DESCRIPTION OF THE INVENTION

Figure 1:
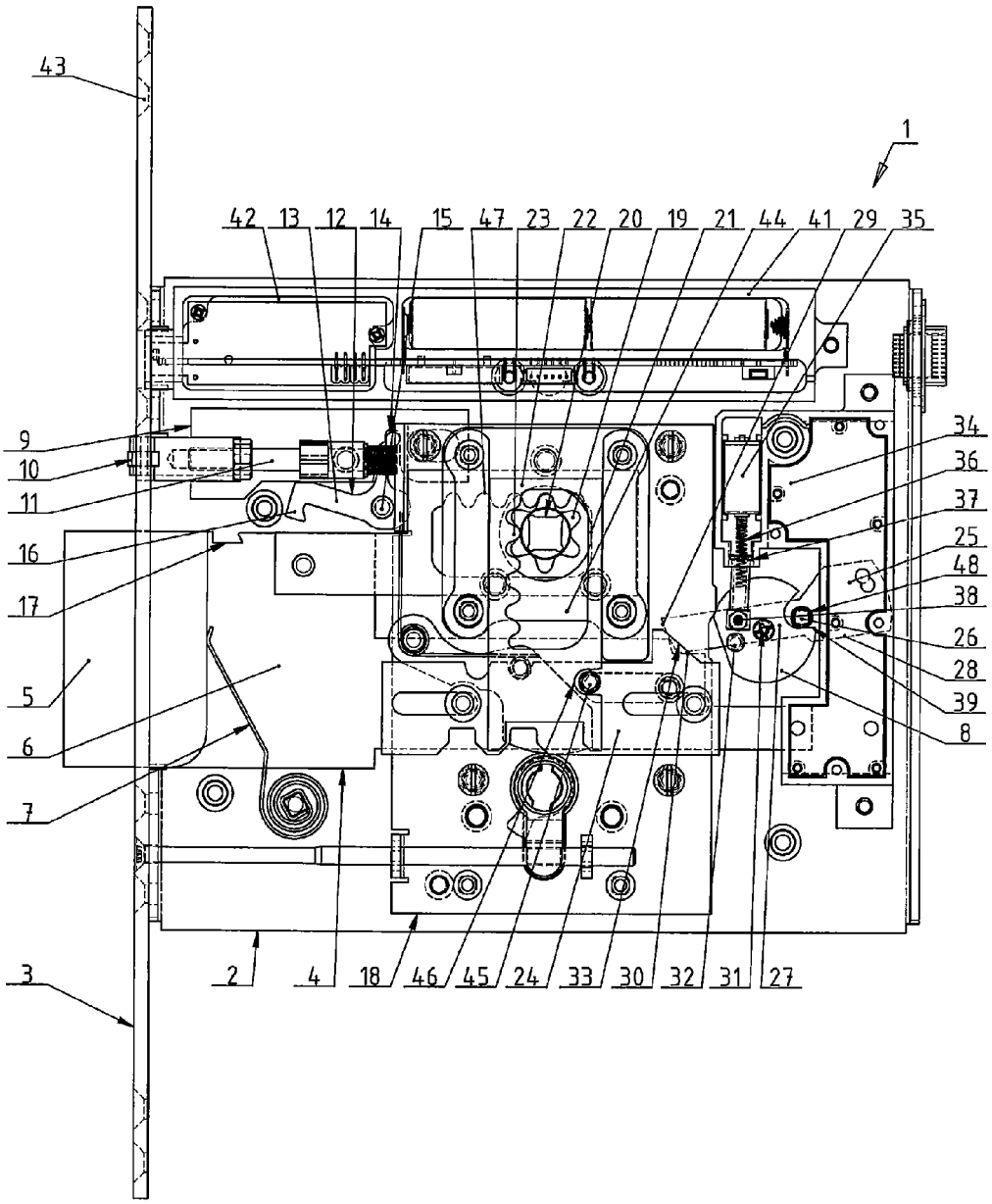
FIG. 1 schematically shows the lock according to the invention in the closed position.
Figure 2:
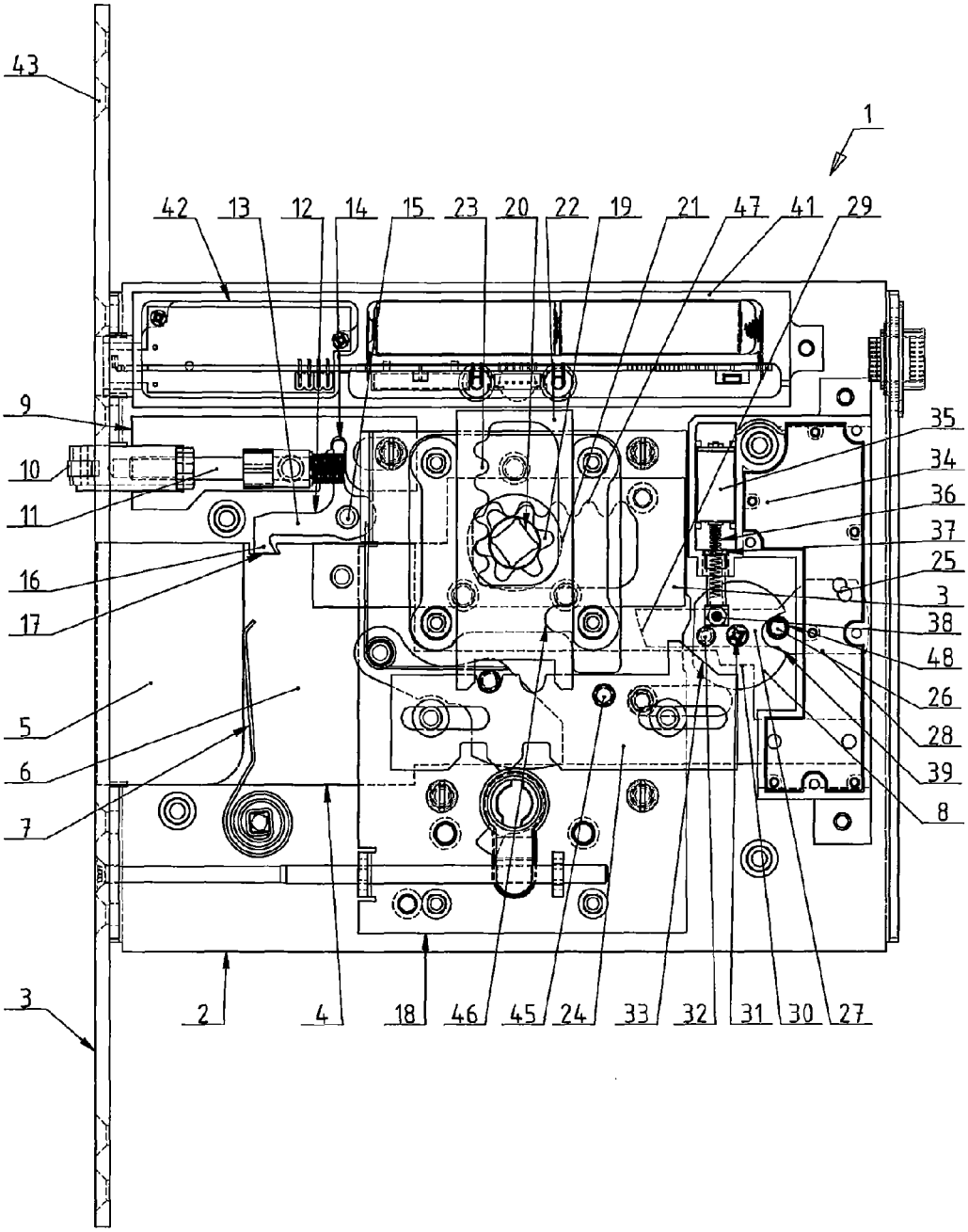
FIG. 2 shows the lock of FIG. 1 in the open position.

FIGS. 1 and 2 each show schematic diagrams of the lock 1 according to the invention, wherein FIG. 1 shows the lock 1 in the closed position, and FIG. 2 shows the lock 1 in the open position.

The lock 1 according to the invention has a lock case 2 in a known manner. This is closed at the end by means of a face plate 3. In the assembled state, the lock case 2 is inserted into a correspondingly formed receiving hole in a door leaf, and the face plate 3 is screw-fastened to the door leaf using corresponding bores 43.

The lock 1 has a lock bolt 4. This is preferably formed in one piece from a bolt head 5 and a bolt body 6. In relation to the plane of the drawing in FIGS. 1 and 2, the lock bolt 4 can be moved to the left out of the open position shown in FIG. 2 into the closed position shown in FIG. 1, and vice versa to the right out of the closed position shown in FIG. 1 into the open position shown in FIG. 2. In the closed position of FIG. 1, the lock bolt 4 engages with its bolt head 5 in a correspondingly formed recess in a closing plate (not shown in detail) when the door is closed. It is then not possible to open the door. The door can only be opened when the lock 1 is moved from its closed position shown in FIG. 1 into its open position shown in FIG. 2, i.e. the lock bolt 4 is moved to the right in relation to the drawing planes of FIGS. 1 and 2. The bolt head 5 then no longer engages in the associated recess in the closing plate, so it is then possible to open the door (not shown in the figures).

The lock 1 has a manually operated drive 21, by means of which the lock bolt 4 can be moved from its closed position shown in FIG. 1 into its open position shown in FIG. 2. The drive 21 has a bolt slide 44 and an operating slide 22 that interacts with the bolt slide 44.

The bolt slide 44 and the operating slide 22 have toothed profiles 23, 47. These toothed profiles 23, 47 interact with a gear wheel 19. The gear wheel 19 in turn has a rectangular bore 20. In the assembled state, a drive shaft which projects through the lock 1 is received by this rectangular bore 20. The drive shaft has a handle on both sides, for example in the form of a rotary knob.

When operated, one of the two operating handles is grasped by a user and turned clockwise to move the lock bolt 4 out of the closed position shown in FIG. 1 and into the open position shown in FIG. 2. The gear wheel 19 also turns as a result of this turning movement. The operating slide 22, which can move upwards or downwards in relation to the drawing planes of FIGS. 1 and 2, moves upwards as a result of this turning movement of the gear wheel 19, force being transmitted via the toothed profile 23 which meshes with the gear wheel 19. The bolt slide 22 likewise moves as a result of the turning movement of the gear wheel 19, but from left to right and in the opposite direction in relation to the drawing planes of FIGS. 1 and 2. The turning movement of the gear wheel 19 introduced by one of the handles is therefore ultimately converted into a displacement of the bolt slide 44, the bolt slide 44 being moved either from left to right or from right to left in relation to the drawing planes of FIGS. 1 and 2 in correspondence with the turning direction of the gear wheel 19.

The bolt slide 44 is connected in a force-transmitting manner to the bolt body 6 of the lock bolt 4. A displacement movement of the bolt slide 44 is thus transmitted to the lock bolt 4. A turning movement of the gear wheel 19 introduced by means of the drive 21 in this respect results in a displacement movement of the lock bolt 4.

Force is applied to the lock bolt 4 by a spring 7, which is supported on the lock case 2. When the lock bolt 4 is extended, i.e. in the closed position of the lock bolt 4 shown in FIG. 1, the spring 7 is in a relaxed position. If the lock bolt 4 is displaced into its open position shown in FIG. 2, the spring 7 is tensioned, so the lock bolt 4 is spring-loaded in its open position shown in FIG. 2.

The lock bolt 4 is held in its open position by a pawl 12. The pawl is formed as a pivotable lever having a first lever arm 13 and a second lever arm 14. The lever arm 13 is formed on the lock bolt side. The second lever arm 14 is connected to a pin 11 of a release means 9. The pawl 12 is pivoted about an axis of rotation 15 formed between the first lever arm 13 and the second lever arm 14. In the open position of the lock bolt 4 shown in FIG. 2, the pawl 12 engages with a blocking nose 16 arranged on the first lever arm 13 in a recess 17 provided by the lock bolt 4. In this position, the pawl 12 holds the lock bolt 4 in position and therefore prevents the lock bolt 4 from moving to the left in relation to the drawing planes of FIGS. 1 and 2 owing to the spring force acting on the lock bolt 4.

The lock 1 has a release means 9, also referred to as a control catch. This release means 9 in turn has a head section 10 and a pin 11, which are connected to each other by means of a slot arrangement. The head section 10 projects through a recess formed in the face plate 3, as can be seen in FIGS. 1 and 2. The pin 11 interacts with the pawl 12 explained above. The entire release means 9 is arranged in a longitudinally displaceable manner in the lock case 2, such that it can be displaced from left to right or from right to left in relation to the drawing planes of FIGS. 1 and 2.

The function of the release means 9 is as follows: As a result of the closing movement of the door bearing the lock 1 according to the invention, the head section 10 of the release means 9 runs on a corresponding counterbearing provided by the closing plate on the frame side. As a result of this the release means 9 moves to the right in relation to the drawing planes of FIGS. 1 and 2. As a result of this displacement movement, the pawl 12 pivots clockwise about the axis of rotation 15, with the result that the blocking nose 16 borne by the first lever arm 13 of the pawl 12 moves out of the recess 17 of the lock bolt 4. The lock bolt 4 is then released, which means that the lock bolt 4 is automatically extended to the left in relation to the drawing planes of FIGS. 1 and 2 owing to the spring force acting on the lock bolt 4. The lock bolt 4 is in this respect moved automatically out of the open position shown in FIG. 2 into the closed position shown in FIG. 1. The lock 1 according to the invention can in this respect also be referred to as a self-closing lock 1.

The release means 9 can advantageously be adjusted to the dimensions of the gap at the installation point using a threaded rod/threaded nut connection between the head section 10 and the pin 11. This ensures reliable functioning of the release means 9.

It is only possible to move the lock bolt 4 back out of the closed position shown in FIG. 1 into the open position shown in FIG. 2 after previous release by means of the blocking mechanism 18. The blocking mechanism 18 can be a conventional profiled cylinder.

In the closed state of the lock 1 shown in FIG. 1, a displacement movement of the lock bolt 4 is prevented in that a bolt block 25 with a blocking nose 29 arranged at the end of an arm 27 engages in a corresponding recess 30 in the bolt body 6 of the lock bolt 4, as can be seen in particular in FIG. 1. In this position of the bolt block 25, it is not possible for the lock bolt 4 to move, i.e. the lock bolt 4 is prevented from moving out of the closed position shown in FIG. 1 into the open position shown in FIG. 2.

The bolt block 25 is formed as a lever which can be pivoted about a pivot axis 26. The bolt block 25 has an arm 27 and a lever projection 28. At the other end, the arm 27 bears the blocking nose 29 explained above, which engages in the recess 30 of the bolt body 6 of the lock bolt 4 when the lock 1 is in the closed position. The bolt block 25 is preferably operated by means of an electric drive 34. The electric drive 34 is however not coupled to the arm 27 of the bolt block directly but by a gearing mechanism.

To this end, FIGS. 3 to 6 show details of the bolt block 25. The manner of functioning is explained using different positions.

A gearing mechanism which is coupled to the electric drive 34 is situated on the arm 27 of the bolt block. This gearing mechanism comprises a driving and blocking member in the form of a circular disc 8. The disc 8 is likewise mounted pivotably on the arm 27 of the bolt block 25 at a distance from the stationary pivot axis 26 thereof. The disc 8 has a recess 39, which engages with a stationary peg 48. The stationary peg 48 is arranged axially to the stationary pivot axis 26 of the bolt block 25. Furthermore, the circular disc 8 has a flattened portion 40 on an edge opposite the recess 39. The electric drive 34 is coupled to the disc 8 at an articulation point 38 which lies approximately opposite the recess 39 in relation to the movable pivot axis 31 of the disc 8. In the exemplary embodiment, the articulation point 38 of the electric drive 34 lies on a connection line between the pivot axis 31 and an arc section which borders the flattened portion 40. This arc section forms a blocking face 49. The radii between the pivot axis 31 of the disc 8 and the articulation point 38 on one side, and between the pivot axis 31 of the disc 8 and the recess 39 on the other side, enclose an obtuse angle.

Figure 3:
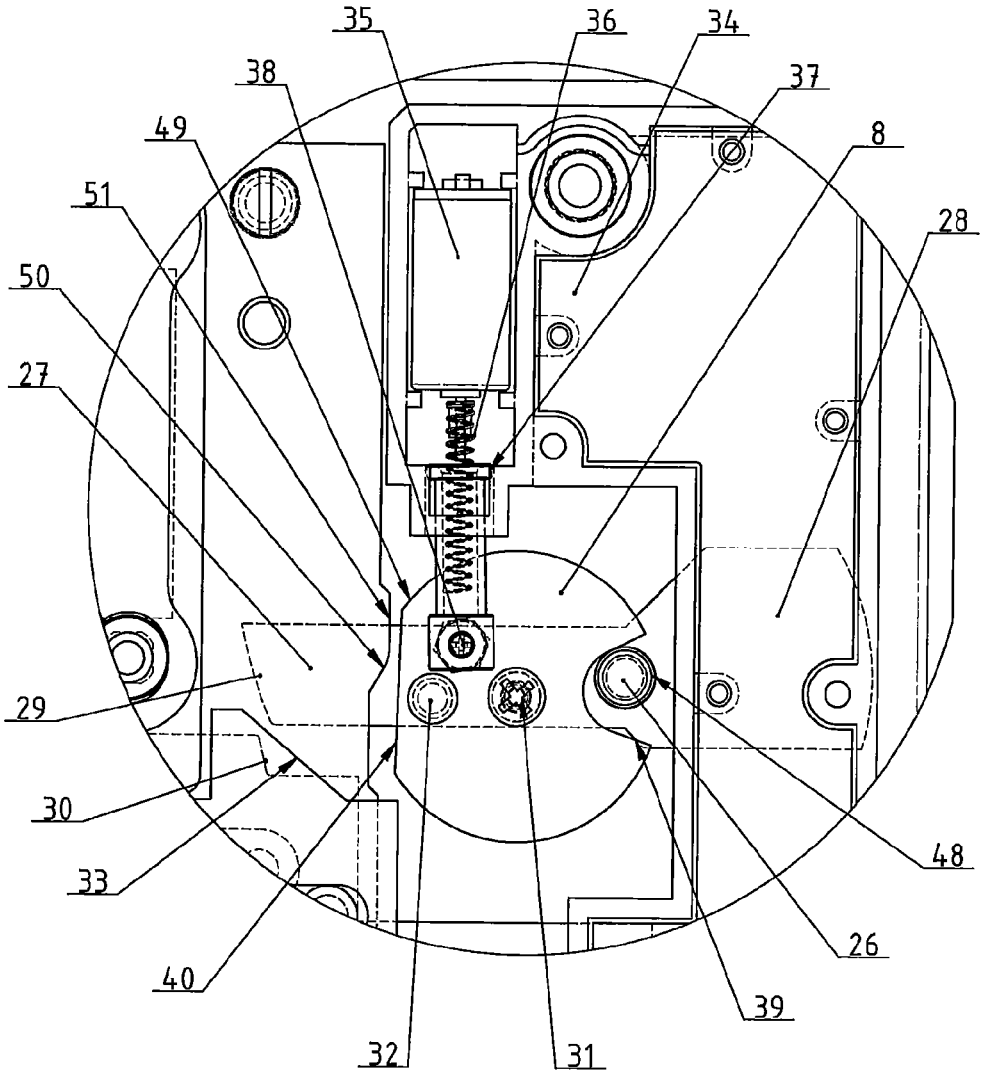
FIG. 3 shows a bolt block in the unlocked position as a detail of FIG. 1.

FIG. 3 shows the bolt block 25 in the unlocked position. The arm 27 is aligned horizontally in the drawing plane. The blocking nose 29 is disengaged from the recess 30 of the bolt body 6. The flattened portion 40 of the disc 8 is aligned vertically and the articulation point 38 of the electric drive 34 is in the uppermost position. At the same time, the upper edge of the recess 39 bears against the peg 48.

Figure 4:
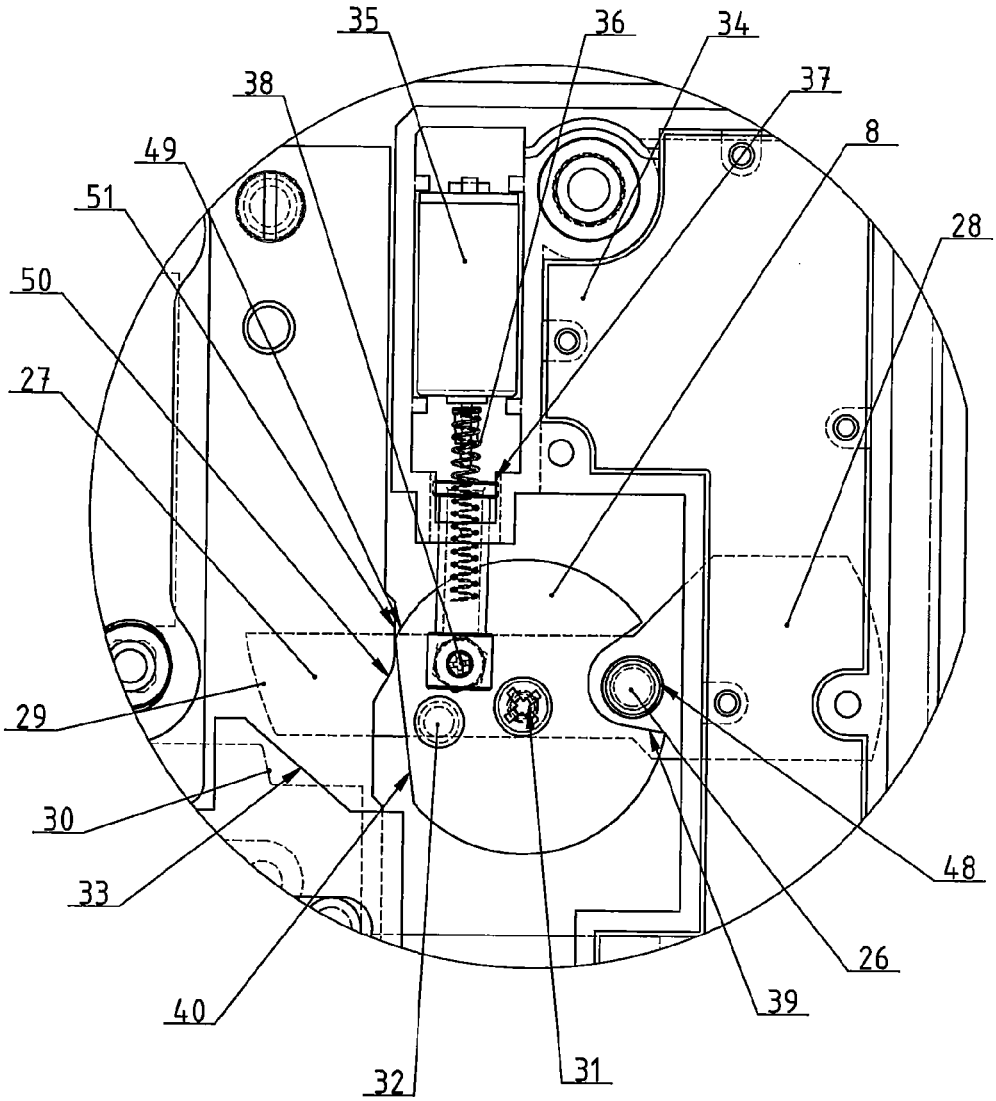
FIG. 4 shows the bolt block in a first intermediate position.

FIG. 4 shows the bolt block 25 in a first intermediate position. The arm 27 is still aligned horizontally in the drawing plane. The disc 8 is however pivoted a little counterclockwise. An edge of the transition between the flattened portion 40 and the arc section 49 of the disc 8 bears against a stationary sliding face 51. The articulation point 38 of the electric drive 34 is lower. At the same time the lower edge of the recess 39 moves closer to the peg 48.

Figure 5:
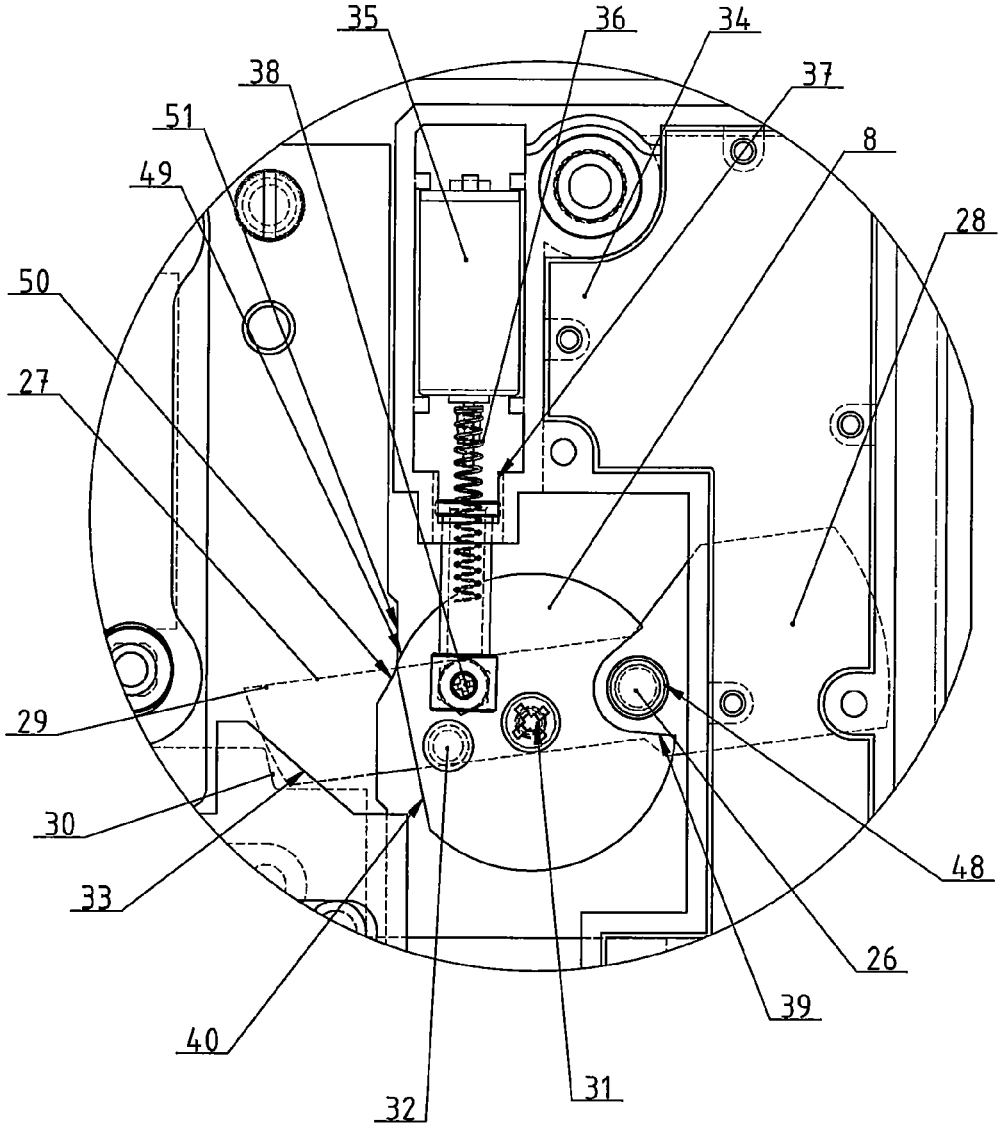
FIG. 5 shows the bolt block in a second intermediate position.

FIG. 5 shows the bolt block in a second intermediate position. The arm 27 is now tilted downwards. The blocking nose 29 is engaged with the recess 30 of the bolt body 6. It is now no longer possible to displace the bolt body 25. However, there is still a risk that the bolt block 25 can be pivoted in the opposite direction by impacts. Although the disc 8 is not pivoted further, the edge of the transition between the flattened portion 40 of the disc 8 and the arc section 49 of the disc 8 has slid down and is situated at a transition between the vertical stationary sliding face 51 and the oblique undercut stationary stop face 50.

Figure 6:
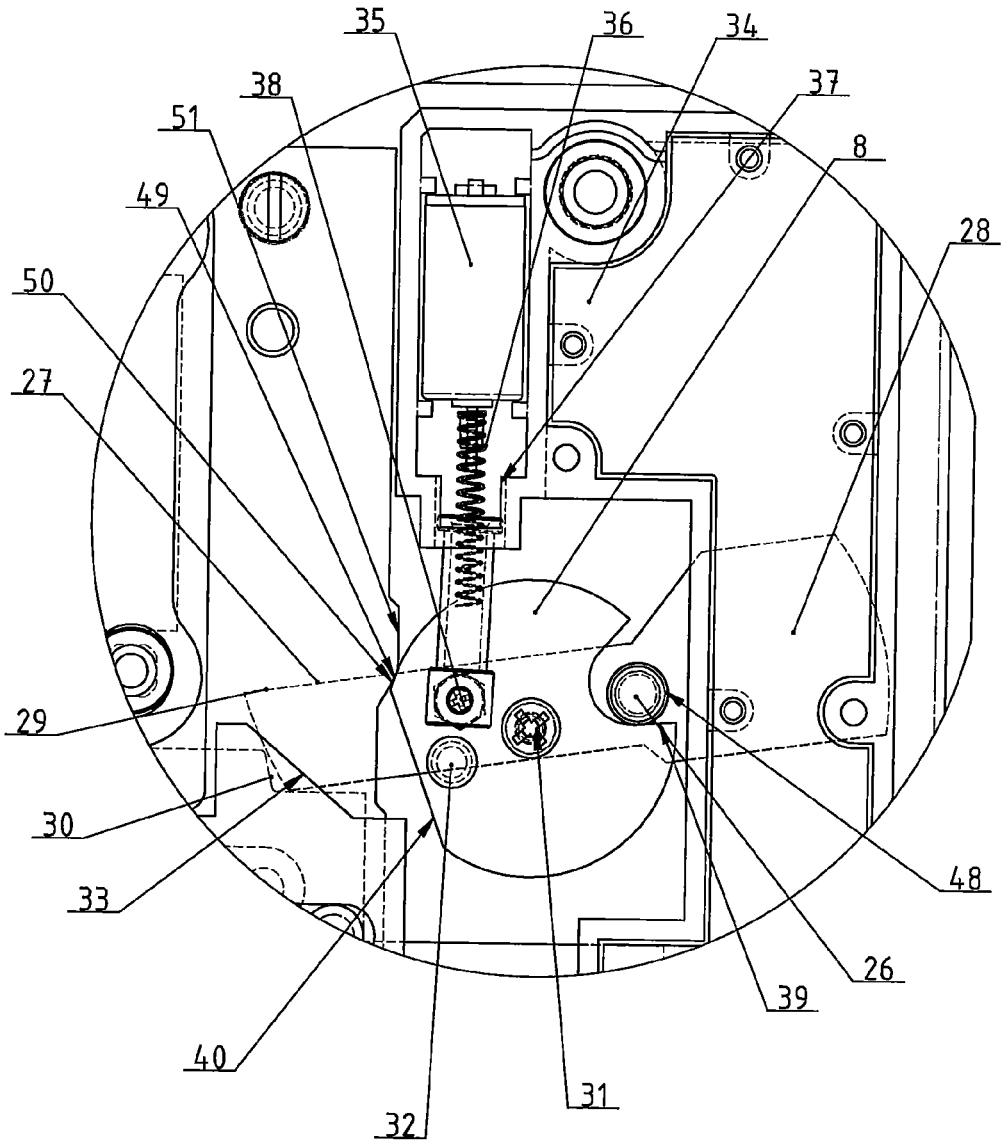
FIG. 6 shows the bolt block in a locked and blocked position.

FIG. 6 shows the bolt block 25 in a locked and blocked position. After sliding past the transition between the vertical stationary sliding face 51 and the oblique undercut stationary stop face 50, the arm 27 has reached its final, tilted position. Continued running of the electric drive 34 has pivoted the disc 8 further counterclockwise. The arc section of the disc 8 which acts as a blocking face 49 has thereby passed into a position opposite the stationary stop face 50. The articulation point 38 of the electric drive 34 is at its lowest position.

In this position it is no longer possible to pivot the bolt block 25 back. This is because the pivot radius lies such in relation to the pivot axis 26 of the bolt block 25 that the blocking face 49 would butt against the stationary stop face 50. The arm 27 can only be moved back into the horizontal position when the disc 8 is pivoted clockwise and the edge of the transition between the flattened portion 40 of the disc 8 and the arc section 49 of the disc 8 is no longer situated under the stationary stop face 50.

In order to facilitate the transition from the blocked state to the unblocked state and vice versa, while minimizing wear and drive energy of the electric drive, the faces of the disc 8, the stationary stop face 50 and the sliding face 51, which slide against each other, can be optimized. The transition on the disc side between the blocking face 49 and the flattened portion 40 can be rounded, as can the transition between the stop face 50 and the sliding face 51. Furthermore, the stop face 50 can be concave. It is also possible for the blocking face 49 and/or the stop face 50 to be provided with variable radii of curvature so that the block builds gradually and removal of the block is facilitated.

The bolt block 25 furthermore bears an operating means 32 in the preferred form of a pin. This pin interacts with a slide in the form of a blocking slide 24. The blocking slide 24 can be moved to the left and right and back in relation to the drawing planes of FIGS. 1 and 2. The blocking slide 24 has a ramp 33 on the bolt block side, which interacts with the operating means 32 provided by the bolt block 25. If the blocking slide 24 is moved to the right in relation to the drawing plane of FIG. 1, starting from the closed position of the lock 1 shown in FIG. 1, the ramp 33 of the blocking slide 24 runs on the operating means 32 of the bolt block 25, as a result of which the bolt block 25 is unblocked and then released.

The blocking slide 24 furthermore bears a closing part 45 in the form of a spike. When the lock 1 is in the closed position shown in FIG. 1, the slide 24 can, as shown in FIG. 1, be moved to the left in relation to the drawing plane of FIG. 1 by means of the blocking mechanism 18, so the closing part 45 of the blocking slide 24 penetrates a slot 46 in the operating slide 22 associated with the drive 21. When the blocking slide 24 is in this position, operation of the lock 1 is blocked, as the drive 21 is blocked. A displacement movement of the lock bolt 4 can thus be prevented independently of the position of the bolt block 25.

The already mentioned electric drive 34 has an electric motor 35, which is coupled to the gearing mechanism of the bolt block 25 by means of a rotary-linear converter formed from a spiral spring 36 and a peg 37. As soon as the electric motor 35 is put into operation, for example by wireless or wired remote control, force is transmitted to the disc 8. As a result of a turning movement, the spiral spring 36 rotates, as a result of which the peg 37 moves upwards or downwards in the drawing plane.

The electric motor 35 is supplied with electrical energy by means of batteries (not shown in the figures). These are arranged in a battery case 41, which is accommodated by a compartment 42 in the lock case 2. Alternatively, manual operation is also possible.

An electronic system (not shown in detail in the figures) for monitoring and controlling the electric motor arrangement 34 is also provided. The electric motor arrangement 34 is preferably operated by wireless remote control, the latter operating in a low-frequency range so that problem-free functioning is possible despite the solid metallic lock case 2. Alternatively, wired control by means of an operating unit is also possible.

LIST OF REFERENCE SYMBOLS

1. Lock
2. Lock case
3. Face plate
4. Lock bolt
5. Bolt head
6. Bolt body
7. Spring
8. Disc
9. Release means
10. Head section
11. Pin
12. Pawl
13. First lever arm
14. Second lever arm
15. Axis of rotation
16. Blocking nose
17. Recess
18. Blocking mechanism
19. Gear wheel
20. Rectangular bore
21. Drive
22. Operating slide
23. Toothed profile
24. Blocking slide
25. Bolt slide
26. Stationary pivot axis
27. Arm
28. Lever projection
29. Nose
30. Recess
31. Movable pivot axis
32. Operating means
33. Ramp
34. Electric drive
35. Electric motor
36. Spiral spring
37. Peg
38. Articulation point
39. Recess
40. Flattened portion
41. Battery case
42. Compartment
43. Bore
44. Bolt slide
45. Closing part
46. Slot
47. Toothed profile
48. Peg
49. Blocking face
50. Stop face
51. Sliding face

What is claimed is:

1. A security lock, comprising:

a blocking mechanism;

a lock bolt that interacts with the blocking mechanism;

a manually operated drive for operating the lock bolt;

a bolt block having a block position that blocks movement of the lock bolt, said bolt block comprising a pivotable lever that can be operated by an electric drive, said bolt block has a blocking nose formed on a lock bolt side that engages in a correspondingly formed recess in the lock bolt; and a gearing mechanism arranged between the bolt block and the electric drive, said gearing mechanism being arranged to move the bolt block from a release position into a block position and vice versa, and to block the bolt block from pivoting in the block position;

wherein the gearing mechanism is a driving and blocking member, which is mounted pivotably on the pivotable lever of the bolt block at a distance from a stationary pivot axis thereof, the driving and blocking member has a recess that engages with a stationary peg, the electric drive is coupled to the driving and blocking member at an articulation point that lies opposite the recess in relation to the movable pivot axis of the driving and blocking member or the articulation point is arranged at an obtuse angle to the position of the recess, and when the bolt block is in the block position the driving and blocking member can be pivoted into a blocking position in which a blocking face of the driving and blocking member can be moved into a position opposite a stationary stop face.

2. The security lock according to claim 1, wherein the stationary peg is arranged axially on the stationary pivot axis of the pivotable lever of the bolt block.

3. The security lock according to claim 1, wherein the driving and blocking member comprises a circular disc which can be pivoted about its center, the recess is located on an edge of the disc, a flattened portion is located on the disc opposite the recess, and the articulation point of the electric drive lies on a connection line between the center and the blocking face.

4. The security lock according to claim 3, wherein a transition on the disc side between the blocking face and the flattened portion and/or a transition between the stop face and a sliding face is rounded.

5. The security lock according to claim 3, wherein the stop face is concave, and the blocking face and/or the stop face have variable radii of curvature.

6. The security lock according to claim 1, wherein the bolt block is arranged to be released and pivoted by a blocking slide that engages with the blocking mechanism.

7. A security lock, comprising:

a blocking mechanism;

a lock bolt that interacts with the blocking mechanism;

a manually operated drive for operating the lock bolt;

a bolt block having a block position that blocks movement of the lock bolt, said bolt block comprising a pivotable lever that can be operated by an electric drive, said bolt block has a blocking nose formed on a lock bolt side that engages in a correspondingly formed recess in the lock bolt; and a gearing mechanism arranged between the bolt block and the electric drive, said gearing mechanism being arranged to move the bolt block from a release position into a block position and vice versa, and to block the bolt block from pivoting in the block position;

wherein the bolt block is arranged to be released and pivoted by a blocking slide that engages with the blocking mechanism; and wherein the driving and blocking member comprises an operating means in the form of a pin, and the blocking slide comprises a ramp that interacts with the operating means.

8. The security lock according to claim 1, wherein the electric drive has an electric motor and a rotary-linear converter that couples the electric motor to the gearing mechanism.

9. The security lock according to claim 8, wherein the rotary-linear converter has a rotatable spiral spring coupled to a peg, and the peg engages in the rotatable spiral spring and is connected to an operating rod that can be moved in a linear manner.

10. The security lock according to claim 7, wherein the electric drive has an electric motor and a rotary-linear converter that couples the electric motor to the gearing mechanism.

11. The security lock according to claim 10, wherein the rotary-linear converter has a rotatable spiral spring coupled to a peg, and the peg engages in the rotatable spiral spring and is connected to an operating rod that can be moved in a linear manner.

* * * * *